United States Patent [19]

Reed

[11] 4,092,237

[45] May 30, 1978

[54] PROCESS FOR TREATING OIL SHALES

[75] Inventor: Homer Charles Reed, Laguna Beach, Calif.

[73] Assignee: Kerr-McGee Corporation, Oklahoma City, Okla.

[21] Appl. No.: 805,829

[22] Filed: Jun. 13, 1977

[51] Int. Cl.[2] ..... C10G 1/02; C10B 53/06

[52] U.S. Cl. ..... 208/11 R; 201/16; 201/34; 202/113; 202/121

[58] Field of Search ..... 208/11 R; 201/16, 34, 201/36

[56] References Cited

U.S. PATENT DOCUMENTS

| | | | |
|---|---|---|---|
| 2,723,225 | 11/1955 | Elliot | 208/11R |
| 2,796,390 | 6/1957 | Elliot | 208/11 R |
| 3,044,859 | 7/1962 | Parker | 208/11 R |
| 3,118,746 | 1/1964 | Stratford | 208/11 R |
| 3,520,795 | 7/1970 | Schulman et al. | 208/11 R |
| 4,010,092 | 3/1977 | Deering | 208/11 R |

*Primary Examiner*—Herbert Levine
*Attorney, Agent, or Firm*—William G. Addison

[57] ABSTRACT

In accordance with this invention, oil shale is introduced into a lock which discharges into a closed, vertical, stationary kiln fitted with mechanisms which cause the particulate oil shale to move continuously downwardly in a controlled, uniform plug type flow. The shale is heated by a counter flow of hot, nonoxidizing gases to the temperature required to pyrolyze the kerogen. The gaseous fraction of the kerogen joins the counter flowing gases for removal from the top of the kiln. The hot particulate shale containing the carbonaceous fraction of the kerogen moves downwardly through a second lock into a conveyance connected to the top of a second similar kiln wherein the carbonaceous residue is reacted with gaseous water and oxygen in a cocurrent manner to supply heat to the decarbonized shale and to produce carbon oxides and hydrogen. The heat in the decarbonized shale is then partially removed by a counter flow of a nonoxidizing recycle gas which joins with the carbon oxides and hydrogen to supply heat for retorting in the first kiln. The cooled decarbonized shale passes out of the second kiln through a lock onto a conveyor for disposal.

5 Claims, 1 Drawing Figure

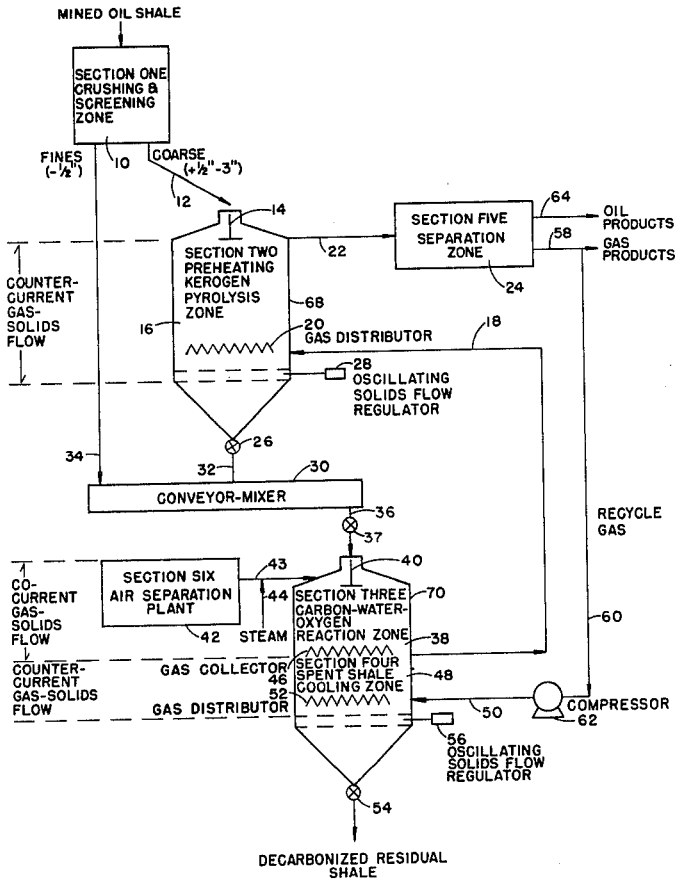

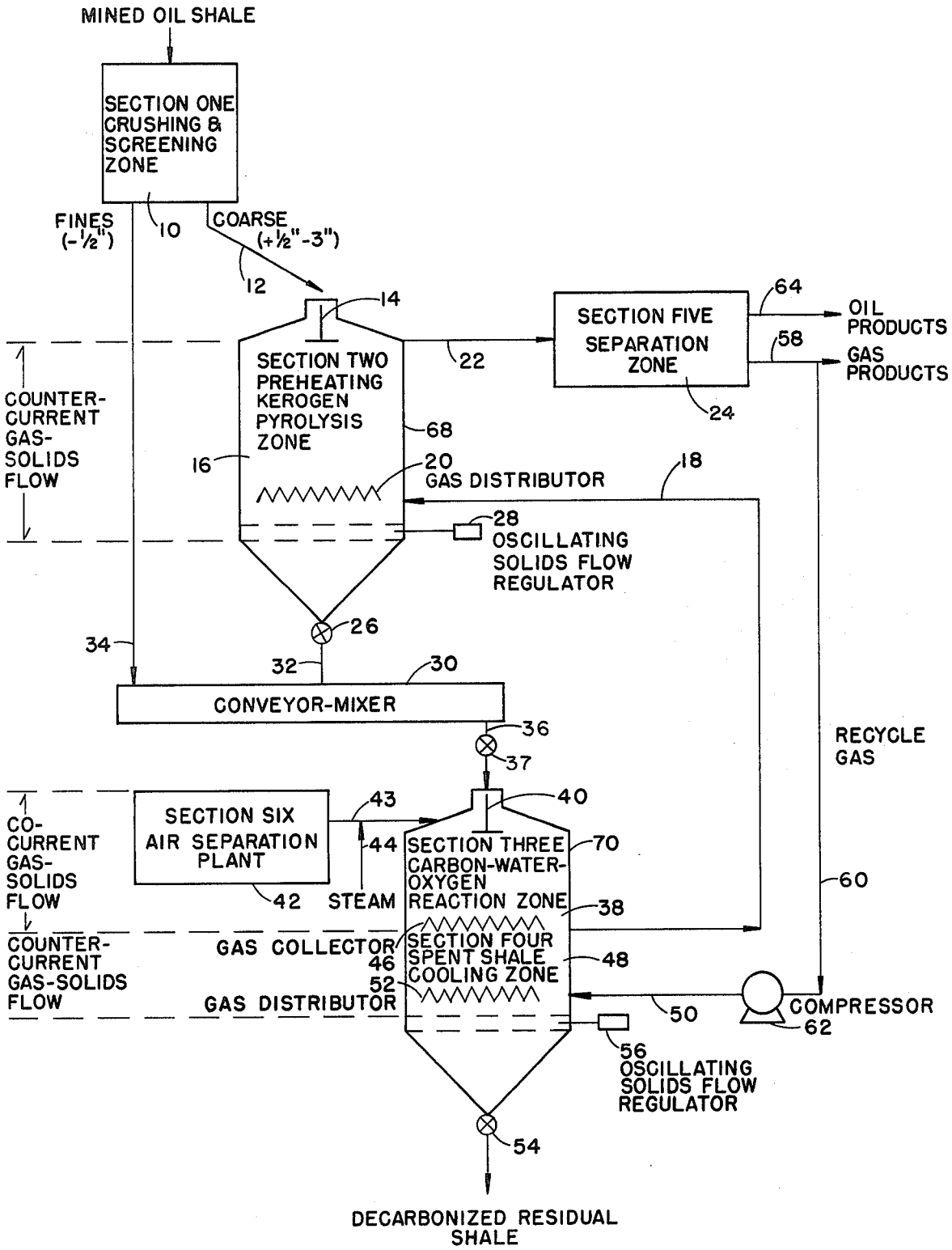
MINED OIL SHALE
SECTION ONE CRUSHING & SCREENING ZONE
FINES (-½")
10
COARSE (+½"-3")
12
14
SECTION TWO PREHEATING KEROGEN PYROLYSIS ZONE
68
16
20
GAS DISTRIBUTOR
22
SECTION FIVE SEPARATION ZONE
24
64
OIL PRODUCTS
58
GAS PRODUCTS
COUNTER-CURRENT GAS-SOLIDS FLOW
18
28
OSCILLATING SOLIDS FLOW REGULATOR
26
34
32
30
CONVEYOR-MIXER
36
37
RECYCLE GAS
CO-CURRENT GAS-SOLIDS FLOW
SECTION SIX AIR SEPARATION PLANT
42
43
44
STEAM
40
SECTION THREE CARBON-WATER-OXYGEN REACTION ZONE
70
38
60
COUNTER-CURRENT GAS-SOLIDS FLOW
GAS COLLECTOR
46
SECTION FOUR SPENT SHALE COOLING ZONE
48
52
GAS DISTRIBUTOR
50
COMPRESSOR
62
56
OSCILLATING SOLIDS FLOW REGULATOR
54
DECARBONIZED RESIDUAL SHALE

PROCESS FOR TREATING OIL SHALES

BACKGROUND OF THE INVENTION

1. Field of the Invention

This invention relates to a process for the production of crude shale oil, hydrocarbon gas, carbon oxide gas and hydrogen suitable for use as a feed stock for refineries, and more particularly, it relates to a process wherein particulate oil shale is retorted to produce crude shale oil, hydrocarbon gas, carbon oxide gas and hydrogen.

2. Description of the Prior Art

Prior art attempts to develop economic processes for utilizing oil shale have followed numerous different paths as disclosed in the following U.S. Pat. Nos.: 2,434,815, 2,901,402, 3,503,869, 3,777,940, 2,560,767, 2,982,701, 3,561,927, 3,803,022, 2,694,037, 3,349,022, 3,663,421, 3,841,992, 2,813,823, 3,384,569, 3,736,247, 3,887,453, 2,832,725, 3,475,319, 3,743,697, 3,939,057.

One such path comprises in situ retorting wherein the shale is burned in place and the heat produced is utilized to decompose the surrounding shale. That process has not been completely satisfactory because the impermeability of the shale prevents movement of gases required for combustion and the recovery of products.

Another path involves direct combustion retorting wherein crushed shale is heated by combustion occurring in the retort by burning injected fuels and/or the residual carbon remaining on the retorted shale with air. Commonly, this is done in a vertical vessel into the top of which fresh shale is fed continuously or batchwise and spent shale is removed from the bottom. The direct combustion retorting process occurs within the vessel in four zones known as: (1) a shale preheating zone forming the upper part of the retort vessel wherein raw particulate shale is introduced and brought up to retorting temperature by direct heat exchange with a heat yielding fluid; (2) a retorting zone wherein the kerogen component of the shale is decomposed to shale vapors and gas; (3) a combustion zone wherein controlled combustion of the available combustible material with air is effected to provide at least a portion of the heat energy required in the retorting operation; and (4) a shale cooling zone wherein the spent shale particles are cooled to a desired low temperature suitable for handling while preheating at least a portion of the recycle gases separated from the shale decomposition products of the retorting operation. Air for combustion is forced into the combustion zone. The hot gases, both combustion and recycle, pass up through the shale causing the kerogen to decompose. The product then is removed as a vapor out the top and condensed.

Equally common are down draft designs wherein the shale is fed upwardly and combustion occurs in the top and product is removed from the bottom. These designs have the advantage of good heat efficiency but disadvantages in that the product is diluted with the combustion gases making recovery of light hydrocarbons difficult and presenting environmental pollution problems relating to disposal of the byproducts of the combustion zone. Also, since the shale contains large amounts of calcite and dolomite which decompose endothermally at 1050–1100° F, temperature control is very critical and difficult in the combustion zone.

Another system of retorting involves indirect heating of the shale using ceramic balls to convey the heat. The spent shale is burned in a separate vessel to supply the heat to raise the temperature of the balls to such a point that when they are mixed with the shale in a retort, the shale is heated to retorting temperatures. The spent shale and the balls then are separated and the ceramic balls are recycled. This process has the advantage that the light gases produced are not diluted with the combustion products. The disadvantages are largely mechanical due to the difficulties of designing the necessary equipment.

Many other processes have been reported, but they essentially operate as variations of those described above and have yet to provide an economic means of retorting the oil shale.

SUMMARY OF THE INVENTION

This invention is a system of unit processes which can be operated on a continuous basis to efficiently convert essentially all the kerogen in particulate oil shale into useful heat and products.

The system emits essentially no harmful gases or liquids to the environment.

A solid shale which is stripped of essentially all organic compounds is produced by the system.

The system has six sections, as follows:

Section one is a plant to crush as mined oil shale and screen it into a coarse ($+\frac{1}{2}$ inch to 3 inches) and a fines ($-\frac{1}{2}$ inch) particulate fraction.

Section two is a shale heating and kerogen pyrolysis zone comprising a vertical, refractory-lined kiln in which the kerogen contained in a continuously moving bed of coarse particulate oil shale from section six is heated at a maximum temperature of about 900° F. The net heat required is supplied by a counter flow of hot nonoxidizing gases generated in sections three and four. The gaseous products of pyrolysis comingle with the nonoxidizing gases and flow into section five after being cooled to about 200° F. by the incoming cold shale particles. The solid, nondistillable carbonaceous residue from the kerogen pyrolysis remains on the shale and flows through a lock out of section two into a mixer-conveyor leading to section three.

Section three is a carbon-water-oxygen reaction zone comprising the upper portion of a second vertical, refractory lined kiln in which oxygen and steam in predetermined and controlled amounts are added cocurrently to a downward flow of shale from section one containing carbonaceous residue which may or may not be admixed with raw oil shale particles. The amount of raw oil shale added, if at all, is determined by the hydrocarbons needed to supply (1) the net heat required to operate the system and (2) the water gas (carbon monoxide plus hydrogen) required to refine the oil produced in section five, carbon dioxide and other reaction gases. The amount of each and ratio of oxygen to steam are also determined by the same criteria. The hot combustion gases and gases due to the decomposition of minerals, water gases resulting from the reaction of oxygen and steam, with the carbon and hydrocarbons in the mixed shales, flow cocurrently downwardly with the spent shale to the gas collector ducts where they are combined with hot upward flowing recycle gas. The combined hot recycle gas, combustion gas, mineral carbonate decomposition gas, and water gas is piped to section two to provide the heat for retorting the oil shale.

Section four is a residual shale cooling zone comprising the lower portion of the second kiln below the gas collector ducts in which a stream of nonoxidizing gas from section five is recycled countercurrent to the combined downward flow of hot, decarbonized shale from section three. The recycle gas both cools the decarbonized residual shale and carries the heat back to section two together with gases generated in section three. The decarbonized residual shale flows downwardly and out of the second kiln through a lock. A uniform, plug flow of the particulate shale in both kilns is due to gravity assisted by a number of oscillating flow regulators.

Section five receives the gases, mists and liquids from section two and separates them into a gas stream and a liquid stream. Part of the gas stream is recycled to section four. The remainder, plus liquid hydrocarbons are piped to an adjacent refinery where corrective methods are used to produce commercial fuels.

Section six is an air separation plant which supplies the gaseous oxygen for section three.

BRIEF DESCRIPTION OF THE DRAWING

The drawing is a schematic flow diagram illustrating a preferred embodiment for the practice of the process of this invention.

DESCRIPTION OF THE PREFERRED EMBODIMENT

Turning now to the drawing, a section one comprising a crushing and screening zone 10 is provided to crush the mined oil shale into a coarse ($+\frac{1}{2}$ to 3 inches) and a fines ($-\frac{1}{2}$ inch) particulate fraction and separate the same. The coarse particulate shale fraction thereafter enters a section two via a line 12 comprising a feed mechanism of any type well known in the art and is distributed by a solids distributor 14.

Section two comprises a shale preheating-kerogen pyrolysis zone 16 comprising a vertical refractory lined kiln 68 in which the coarse particulate shale is contained in a downwardly continuously moving bed. The kerogen contained in the coarse particulate shale is removed by pyrolysis reaching a maximum temperature of about 900° F. within the zone 16 and leaves a solid, nondistillable carbonaceous residue on the shale. The net heat required for the pyrolysis is supplied through a line 18 comprising a counter flow of hot nonoxidizing combined gases generated in a section three and a section four. The hot nonoxidizing combined gases entering via line 18 are distributed within zone 16 by a gas distributor 20 to rise within the downwardly moving particulate shale bed and comingle with the gaseous pyrolysis products and flow through a line 22 into a section five comprising a separation zone 24 after being cooled to about 200° F. by the incoming cold particulate oil shale. Thereafter, the pyrolyzed coarse particulate shale on which the solid, nondistillable carbonaceous residue remains exits kiln 68 through a lock 26 controlled by an oscillating solids flow regulator 28 to enter a conveyor-mixer 30 via a line 32. The pyrolyzed shale then is mixed with raw fine particulate oil shale from section one which enters via a line 34 and flows by a line 36 through a lock 37 to enter section three, a second vertical, refractory lined kiln 70.

Section three comprises a carbon-water-oxygen reaction zone 38 comprising the upper portion of the second vertical, refractory lined kiln 70. The pyrolyzed shale and raw oil shale particles entering section three are distributed by a solids distributor 40 within kiln 70 and oxygen and steam in predetermined and controlled amounts are supplied from (i) a section six (an air separation plant 42) through a line 43 and (ii) a steam line 44 to react with the downward flow of shale particles.

The amount of raw oil shale, oxygen and steam added is determined by the hydrocarbons needed to supply the net heat required to operate the system and the water gas required to refine the oil produced in section five. The hot combustion gases and gases due to the decomposition of minerals, water gases resulting from the reaction of oxygen and steam, with the carbon and hydrocarbons in the mixed shales, flow cocurrently downward with the spent shale to a gas collector 46 to combine with hot upward flowing recycle gas from section four. The combined gases comprising hot recycle gas, combustion gas, mineral carbonate decomposition gas and water gas withdrawn by gas collector 46 flows by line 18 to section two to provide the necessary heat for retorting the shale therein and results in a more selective distillation occurring and higher quality products being produced.

Section four comprises a spent shale cooling zone 48 comprising the lower portion of the second kiln 70 below the gas collector in which a stream of recycle nonoxidizing gas from section five entering via a line 50 is distributed by a gas distributor 52 to flow countercurrently to the combined downward flow of hot decarbonized residual shale from section three. The recycle gas cools the decarbonized residual shale and carries the heat back to section two together with the gases generated in section three. Thereafter, the decarbonized residual shale flows downwardly and out of a lock 54 controlled by an oscillating flow regulator 56. A uniform, plug flow of the particulate shale in both kilns is due to gravity assisted by oscillating flow regulators.

Section five comprises a separation zone 24 wherein the gaseous products of section two, comprising gases, mists and liquids are separated into a gas products stream and a liquid or oil products stream. A portion of the gas product stream exiting by a line 58 is recycled to section four via a line 60 and a compressor 62. The remainder, plus liquid hydrocarbons in a line 64, flows to an adjacent refinery (not shown) where suitable methods beyond the scope of this invention are used to produce commercial fuels or to storage.

Section six is an air separation plant 42 which supplies the gaseous oxygen for section three and its operation is also beyond the scope of this invention.

While the present invention has been described with respect to what is presently considered to be a preferred embodiment thereof, it will be understood, of course, that certain changes may be made therein without departing from its true scope as defined by the appended claims.

What is claimed is:

1. A process for producing crude shale oil and gas comprising:

a. passing particulate oil shale through a first vertical, refractory-lined kiln comprising a shale heating-kerogen decomposition zone into a second vertical, refractory-lined kiln comprising a carbon-water-oxygen reaction zone and a shale cooling zone;

b. passing a gas stream containing oxygen and steam into the carbon-water-oxygen reaction zone concurrently with the particulate oil shale passing therethrough under conditions to further heat said particulate oil shale to an elevated temperature and to produce hot reaction gas comprising carbon oxide and hydrogen gases;

c. effecting decomposition of kerogen in said particulate oil shale within said kerogen decomposition zone to produce vaporous products by countercurrently contacting the same with a hot combined gas stream comprising an admixture of said hot carbon oxide and hydrogen gases and heated recycle product gas obtained by recovery of at least a portion of the vaporous products produced within said kerogen decomposition zone;

d. heating said recycle product gas by countercurrent passage through said particulate oil shale passing through said shale cooling zone to transfer heat from said shale to said recycle product gas; and e. recovering at least a portion of said vaporous products from said kerogen decomposition zone.

2. The process of claim 1 wherein the particulate oil shale passage through the vertical refractory-lined kilns is further defined as through a series of locks which control the entry into and exit from the vertical refractory-lined kilns and which operate under flow control.

3. The process of claim 1 wherein the particulate oil shale passed into the carbon-water-oxygen reaction zone from the first vertical refractory-lined kiln is further defined as pyrolyzed particulate shale having a solid, nondistillable carbonaceous residue coating thereon.

4. The process of claim 1 wherein the combining of the hot carbon oxide and hydrogen gas products and recycle gas is further defined as occurring in between the reaction and cooling zones.

5. An apparatus for the production of crude shale oil and gas through treatment of raw particulate oil shale in a reaction system comprising:

at least one refractory-lined kiln;

means for introducing raw particulate oil shale into the refractory-lined kiln such that it passes serially through a shale preheating-kerogen decomposition zone, a carbon-water-oxygen reaction zone and a spent shale cooling zone contained within the kiln and then passes out of the kiln;

means for heating the particulate oil shale in the preheating-kerogen decomposition zone such that vaporous products are produced and recovered;

means for introducing a gas stream comprising oxygen and steam into the carbon-water-oxygen reaction zone such that it passes cocurrently with said particulate oil shale therein under such conditions as to further heat said particulate oil shale by reacting with a carbonaceous material contained thereon to produce hot reducing gases;

means for cooling said particulate oil shale in the spent shale cooling zone such that a recycle product gas recovered from said vaporous products produced by kerogen decomposition and introduced therein passes countercurrently to said particulate oil shale, and is heated thereby;

means for withdrawing the cocurrently passing hot reducing gases from the kiln before entry into the spent shale cooling zone contained therein;

means for withdrawing the countercurrently passing heated recycle product gas from the kiln before entry into the carbon-water-oxygen reaction zone contained therein;

means for mixing the hot reducing gases and heated recycle product gas to form a hot combined gas stream; and means for passing the hot combined gas stream to the preheating-kerogen decomposition zone to provide the means for heating the particulate oil shale therein.

* * * * *